US007850289B2

(12) United States Patent
Hawkins et al.

(10) Patent No.: US 7,850,289 B2
(45) Date of Patent: Dec. 14, 2010

(54) STEERING FLUID JETS

(75) Inventors: Gilbert A. Hawkins, Mendon, NY (US); Kathleen M. Vaeth, Rochester, NY (US); Edward P. Furlani, Lancaster, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 643 days.

(21) Appl. No.: 11/840,296

(22) Filed: Aug. 17, 2007

(65) Prior Publication Data

US 2009/0046129 A1 Feb. 19, 2009

(51) Int. Cl.
*B41J 2/07* (2006.01)
*B41J 2/09* (2006.01)

(52) U.S. Cl. ..... 347/74; 347/77

(58) Field of Classification Search ..... 347/75, 347/73–74, 76–77, 79–82
See application file for complete search history.

(56) References Cited

U.S. PATENT DOCUMENTS 1,941,001 A 12/1933 Hansell
5,623,292 A 4/1997 Shrivastava et al.
6,079,821 A 6/2000 Chwalek et al.
6,206,509 B1 * 3/2001 Lecheheb et al. ..... 347/78
6,213,595 B1 4/2001 Anagnostopoulos et al.
6,450,619 B1 9/2002 Anagnostopoulos et al.
6,517,197 B2 2/2003 Hawkins et al.
6,554,410 B2 4/2003 Jeanmaire et al.
6,830,320 B2 12/2004 Hawkins et al.
6,863,385 B2 3/2005 Jeanmarie et al.
2003/0202053 A1 10/2003 Hawkins et al.
2008/0043062 A1 2/2008 Hawkins et al.

OTHER PUBLICATIONS

U.S. Appl. No. 11/504,960, filed Aug. 16, 2006, Gilbert A. Hawkins et al.

* cited by examiner

*Primary Examiner*—K. Feggins
(74) *Attorney, Agent, or Firm*—William R. Zimmerli

(57) ABSTRACT

A printer includes a printhead and a source of fluid. The printhead includes a nozzle. The fluid is under pressure sufficient to eject a column of the fluid through the nozzle. The fluid has a temperature. An asymmetric thermal modulator is associated with the nozzle and includes a structure that transiently lowers the temperature of a first portion of the fluid as the fluid is ejected through the nozzle and a structure that transiently raises the temperature of a second portion of the fluid as the fluid is ejected through the nozzle.

13 Claims, 16 Drawing Sheets

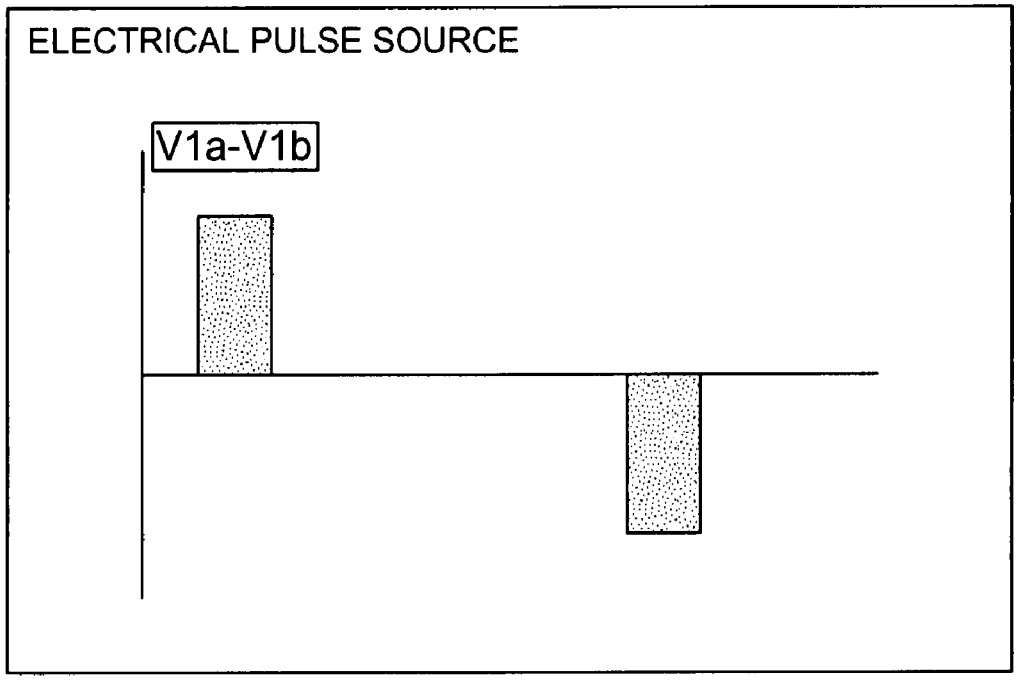
FIG. 2D (i)
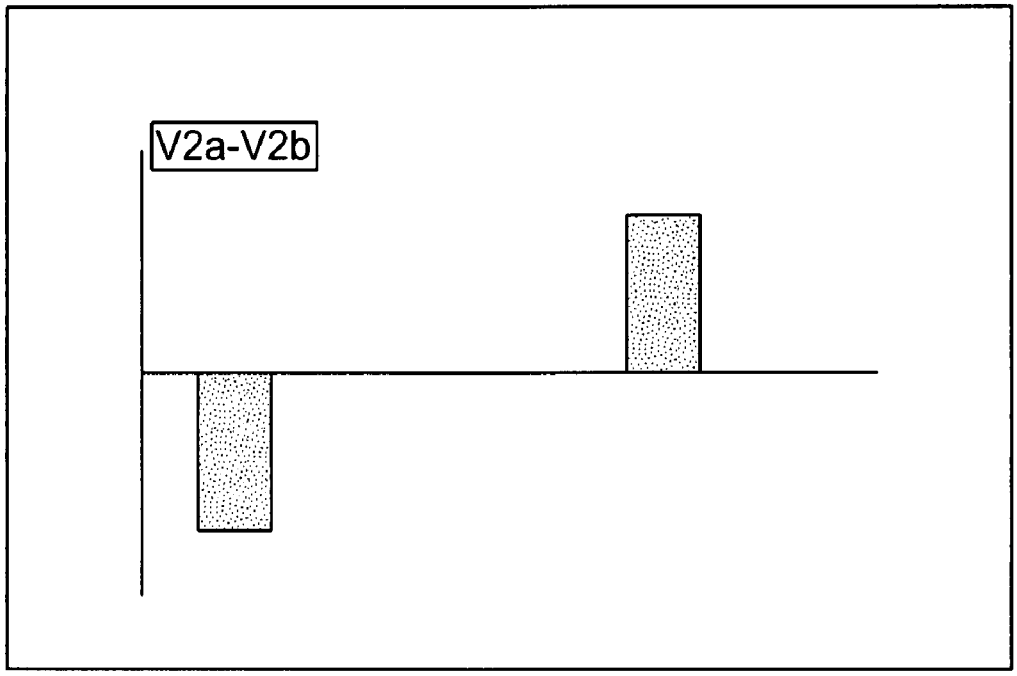
FIG. 2D (ii)

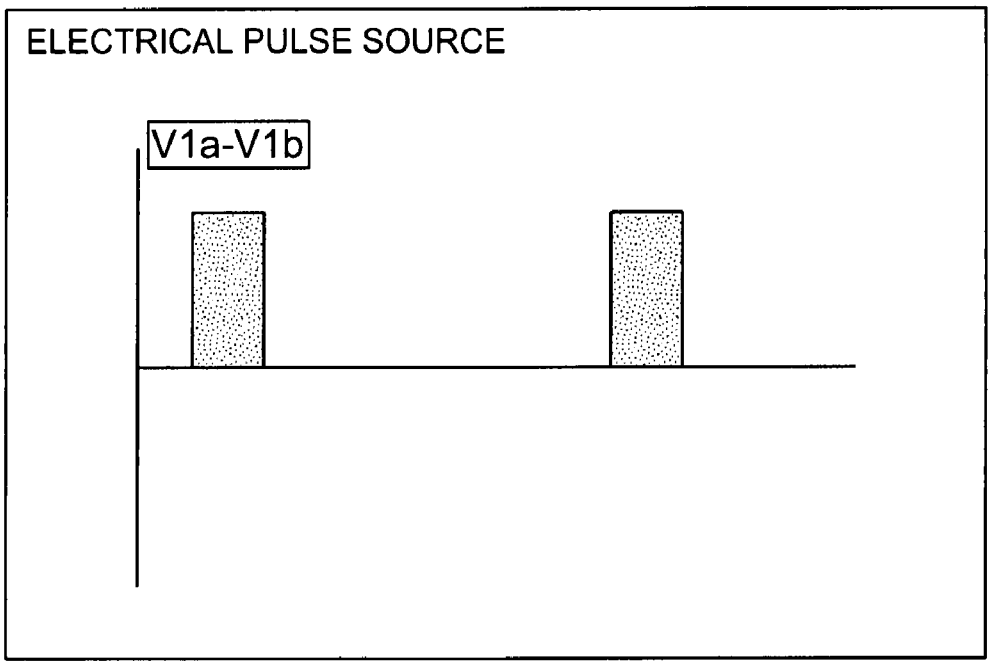
FIG. 2E (i)
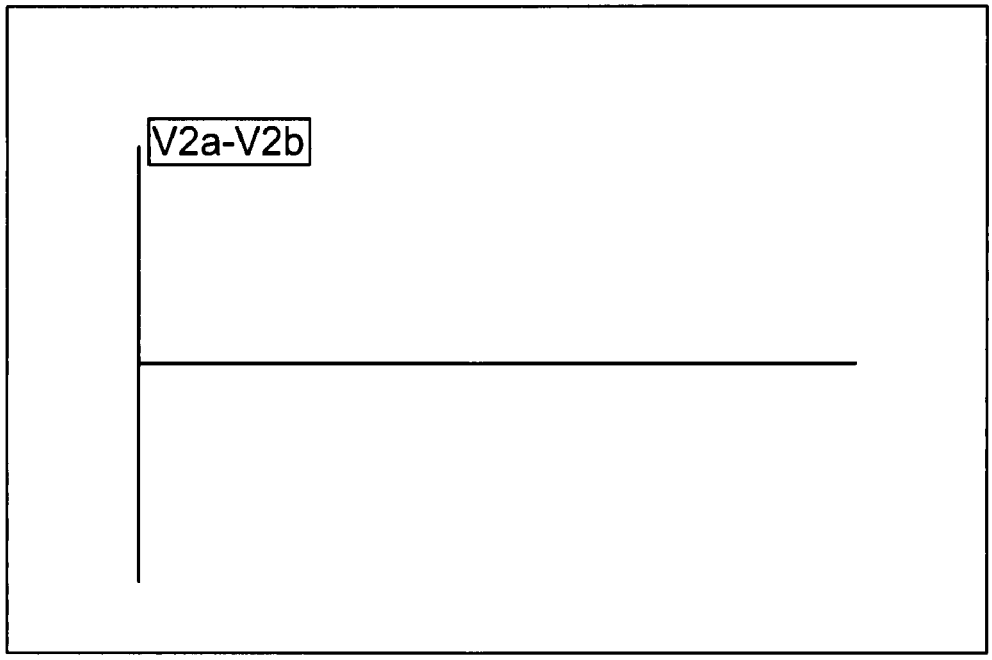
FIG. 2E (ii)

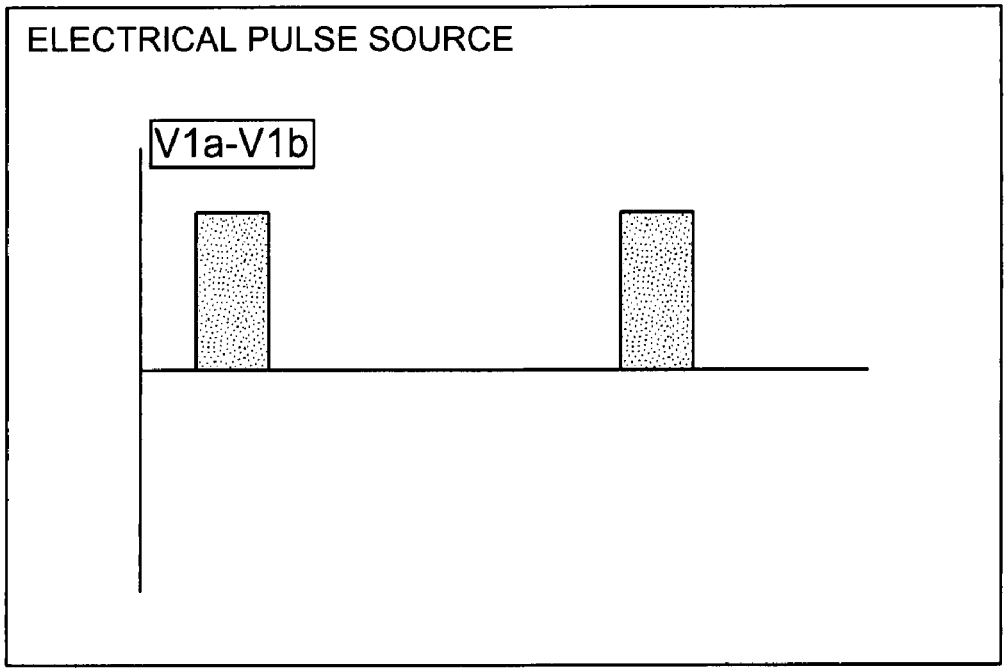
FIG. 3A (i)
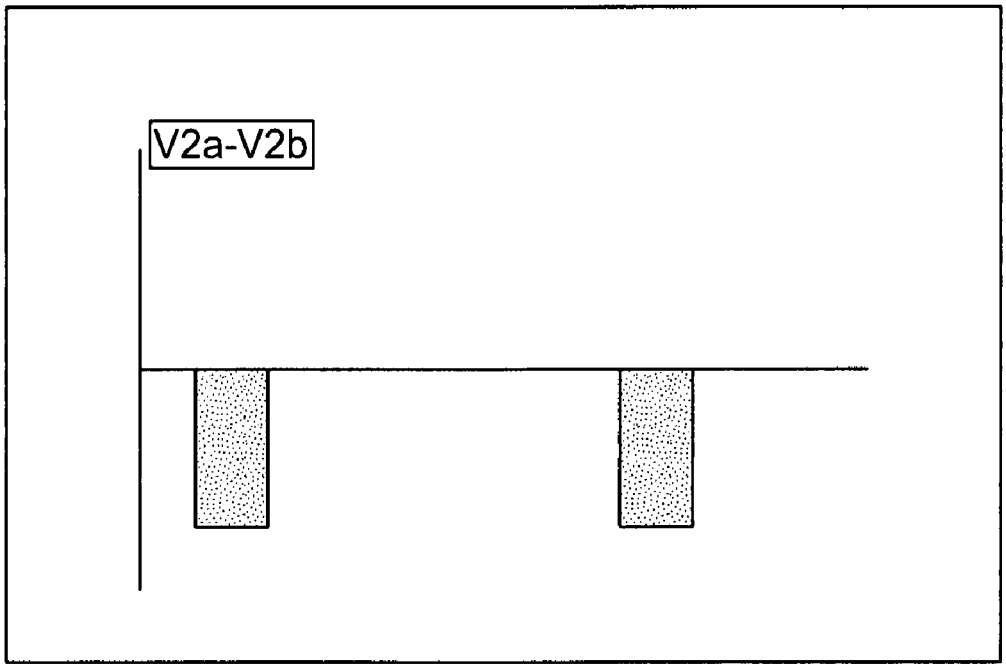
FIG. 3A (ii)

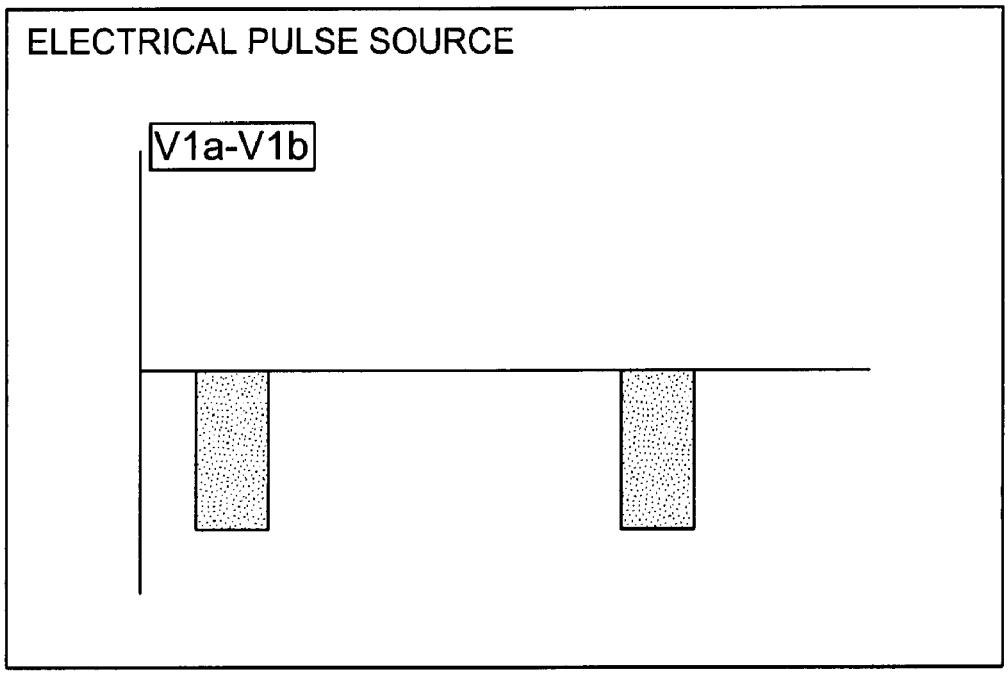
FIG. 3B (i)
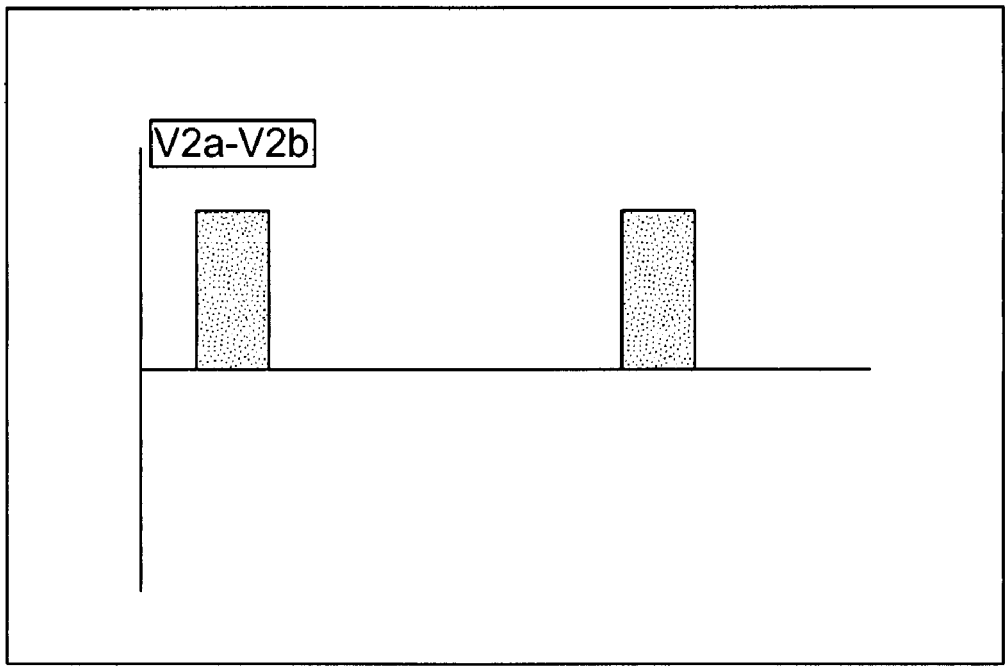
FIG. 3B (ii)

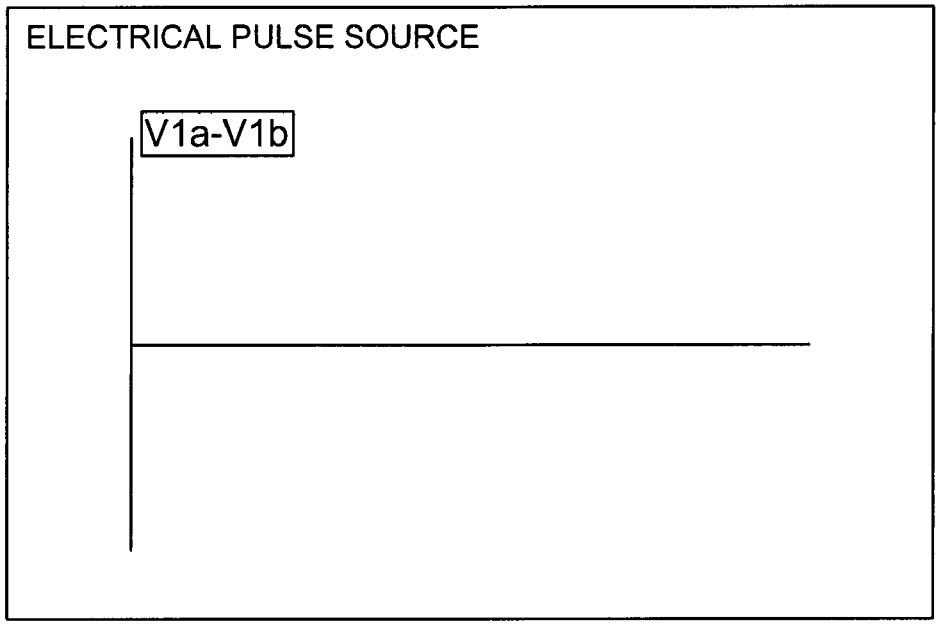
FIG. 3C (i)
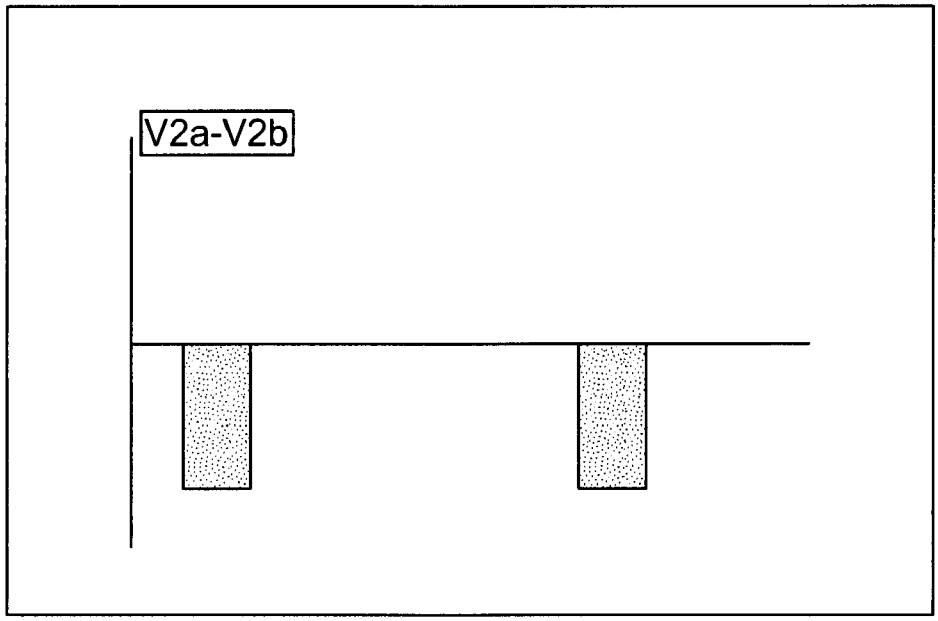
FIG. 3C (ii)

SIMULTANEOUS TEMPERATURE LOWERING PULSE APPLIED TO THE LEFT SIDE OF AN ASYMETRIC THERMAL MODULATOR AND TEMPERATURE RAISING PULSE APPLIED TO THE RIGHT SIDE OF AN ASYMETRIC THERMAL MODULATOR

DEFLECTION ≈ 1.30°

TEMPERATURE LOWERING PULSE APPLIED TO THE LEFT SIDE OF AN ASYMETRIC THERMAL MODULATOR

DEFLECTION ≈ 0.86°

| WAVEFORM AMPLITUDE | TEMPERATURE RAISING PULSE | TEMPERATURE LOWERING PULSE | SIMULTANEOUS TEMPERATURE RAISING AND LOWERING PULSES |
|---|---|---|---|
| 4.5 | 0.21 | 0.86 | 1.30 |
| 5.0 | 0.43 | 0.86 | 1.30 |

FIG. 4C

STEERING FLUID JETS

FIELD OF THE INVENTION

The present invention relates generally to the field of digitally controlled printing devices, and in particular to continuous ink jet printheads that create droplets using thermal modulation and steer droplets using asymmetric application of temperature pulses.

BACKGROUND OF THE INVENTION

Ink jet printing has been currently identified as one of the most successful candidates for the technology of choice in the digitally controlled, electronic printing market. Two prominent forms of this technology are drop-on-demand (DOD) and continuous ink jet (CIJ). CIJ technology was identified as early as 1929, in U.S. Pat. No. 1,941,001 issued to Hansell. In the 1960s, CIJ printing mechanisms were developed that made use of acoustically driven printheads that created ink droplets of uniform size that would be appropriately deflected by electrostatics.

There have been numerous advances in the implementation of CIJ printers. For example, CMOS/MEMS integrated printheads with resistive heating elements can be used to break up a fluid column into drops and to steer (or deflect) the drops along desired trajectories, see, for example, U.S. Pat. Nos. 6,079,821; 6,450,619; 6,863,385; 6,213,595; 6,517,197; and 6,554,410.

Heat can be applied to the fluid column (or jet) via an electrical potential supplied to the printhead heaters. Frequent application of heat pulses creates small drops, whereas less frequent application of heat pulses creates larger drops. The use of heat to break up the drops allows control of drop size at each nozzle. The heat pulses can be small in amplitude and yet still accurately control drop break-off. Heat pulses can be applied symmetrically, for example when the heater is in the shape of a single ring surrounding a nozzle, or asymmetrically, for example when multiple heaters surround a nozzle only one of which is activated.

Heat pulses of larger amplitudes having larger energy content, when applied asymmetrically, cause drop steering (deflection) as well as drop break-off. In such cases, it is usually desirable for the amount of deflection to be as large as possible so that the drops not to be printed can be reliably directed to a catcher or gutter. However, the amount of deflection can be limited because heat pulses of larger amplitudes may cause the fluid to boil or to decompose thermally.

One way of increasing deflection includes adding constituents to the fluids to increase the temperature at which boiling or decomposition occurs. However, fluids so formulated may not be optimal for other functionalities, such as providing color gamete printed images. Another way of increasing deflection, disclosed in U.S. Pat. No. 6,830,320, includes reducing the operating temperature of the fluids and printhead. However the hardware required for such operation increases system complexity and cost.

As such, a need exists to provide increased or larger amounts of fluid jet deflection when compared to conventional deflection techniques for a variety of fluids under a variety of operating conditions without unnecessarily heating the fluids or increasing the likelihood of the fluids to decompose.

SUMMARY OF THE INVENTION

According to one aspect of the present invention, a printer includes a printhead and a source of fluid. The printhead includes a nozzle. The fluid is under pressure sufficient to eject a column of the fluid through the nozzle. The fluid has a temperature. An asymmetric thermal modulator is associated with the nozzle and includes a structure that transiently lowers the temperature of a first portion of the fluid as the fluid is ejected through the nozzle and a structure that transiently raises the temperature of a second portion of the fluid as the fluid is ejected through the nozzle.

According to another aspect of the present invention, a printer includes a printhead and a source of fluid. The printhead includes a nozzle. The fluid is under pressure sufficient to eject a column of the fluid through the nozzle. The fluid has a temperature. An asymmetric thermal modulator is associated with the nozzle and is operable to transiently lower the temperature of only a portion of the fluid as the fluid is ejected through the nozzle.

According to another aspect of the present invention, a method of forming fluid drops includes providing a printhead including a nozzle; providing a fluid under pressure sufficient to eject a column of the fluid through the nozzle, the fluid having a temperature; and transiently lowering the temperature of a first portion of the fluid as the fluid is ejected through the nozzle and transiently raising the temperature of a second portion of the fluid as the fluid is ejected through the nozzle using an asymmetric thermal modulator.

In one example embodiment of the present invention, an asymmetric thermal modulator surrounds a fluid nozzle of a printhead and includes a first and a second side with each side configured to apply either temperature raising or temperature lowering pulses to a fluid jet ejected through the nozzle. Temperature raising pulses increase the temperature of a portion of the fluid jet above the temperature it would otherwise have, while temperature lowering pulses decrease the temperature of a portion of the fluid jet below the temperature it would otherwise have. Electrical addressing circuitry is provided on the printhead to trigger a temperature lowering pulse along one portion of the asymmetric thermal modulator and to simultaneously trigger a temperature raising pulse along a second portion of the asymmetric thermal modulator.

Advantageously, drop break-off and drop steering (deflection) can be achieved using the same asymmetric thermal modulator and electrical addressing circuitry. The fluid jet is deflected by simultaneous application of a temperature lowering pulse to one side of the asymmetric thermal modulator and a temperature raising pulse to the opposite side of the asymmetric thermal modulator. The amount of deflection of the fluid column ejected through the nozzle is increased by the simultaneous application of the temperature lowering pulse and the temperature raising pulse.

BRIEF DESCRIPTION OF THE DRAWINGS

In the detailed description of the example embodiments of the invention presented below, reference is made to the accompanying drawings, in which:

FIGS. 2D(i) and (ii) are exemplary control diagrams showing graphs of voltage waveforms or pulses applied to different sides of an asymmetric thermal modulator with FIG. 2D(i) corresponding to the waveform applied to one side of the asymmetric thermal modulator shown in FIG. 2C (for example, the top side or the right side of the asymmetric thermal modulator shown in FIG. 2C depending on its orientation) and FIG. 2D(ii) corresponds to the waveform applied to the other side of the asymmetric thermal modulator shown in FIG. 2C (bottom side or left side of the asymmetric thermal modulator depending on its orientation), temperature raising (temperature lowering) pulses being shown above (below) the zero-voltage axis in both diagrams;

FIGS. 2E(i) and (ii) are control diagrams showing graphs of voltage waveforms or pulses which cause a temperature raising pulse to be applied to one side of the asymmetric thermal modulator shown in FIG. 2C (for example, the top side or the right side of the asymmetric thermal modulator shown in FIG. 2C depending on its orientation) of an asymmetric thermal modulator with no waveforms or pulses being applied to the other side of the asymmetric thermal modulator shown in FIG. 2C;

FIGS. 3A(i) and (ii) are control diagrams showing graphs of voltage waveforms or pulses applied to different sides of the asymmetric thermal modulator shown in FIG. 2C to deflect a fluid jet in a first direction with temperature raising pulses being applied to the one side of the asymmetric thermal modulator in FIG. 3A(i) and temperature lowering pulses being simultaneously applied to the opposite side in FIG. 3A(ii) in which the fluid jet deflects away from the side to which the temperature raising pulses are applied and toward the side to which temperature lowering pulses are applied;

FIGS. 3B(i) and (ii) are control diagrams showing graphs of voltage waveforms or pulses applied to different sides of the asymmetric thermal modulator shown in FIG. 2C to deflect the jet in a second direction with temperature raising pulses being applied to the one side of the asymmetric thermal modulator in FIG. 3B(ii) and temperature lowering pulses being simultaneously applied to the opposite side in FIG. 3B(i);

FIGS. 3C(i) and (ii) are control diagrams showing graphs of the waveforms applied to the asymmetric thermal modulator shown in FIG. 2C to deflect the jet with temperature lowering pulses being applied to one side of the asymmetric thermal modulator shown in FIG. 2C and no pulses being applied to the other side of the asymmetric thermal modulator shown in FIG. 2C;

FIG. 4C shows tabulated experimental results for the amount of deflection of a fluid jet to which a temperature raising pulse, a temperature lowering pulse, or both, simultaneously, have been applied to one side, the other side, or both sides, respectively, of the asymmetric thermal modulator shown in FIG. 2C in which the fluid jet deflects away from the side to which the temperature raising pulses are applied and toward the side to which temperature lowering pulses are applied.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
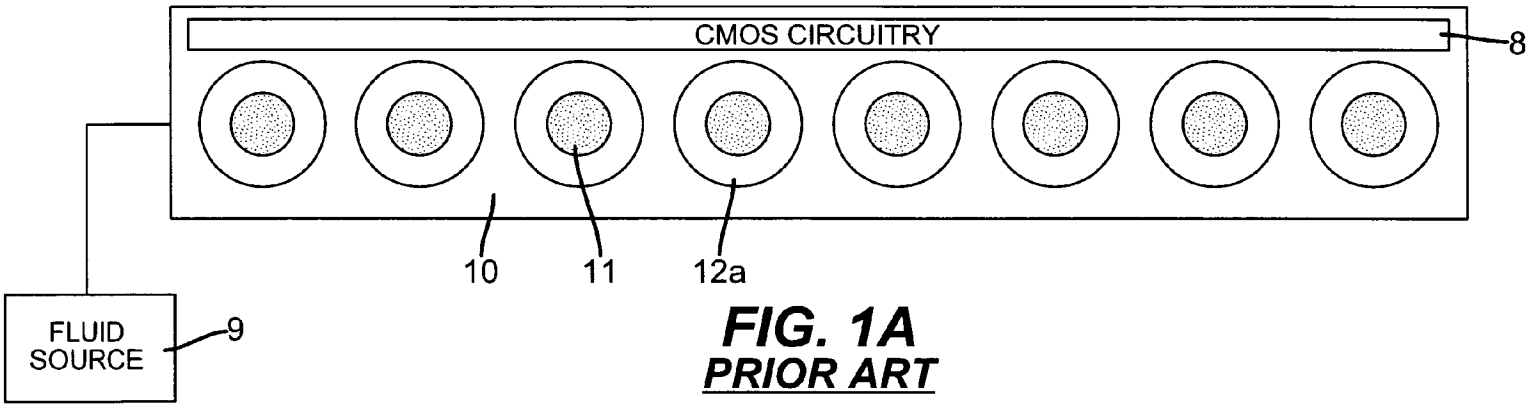
FIG. 1A PRIOR ART
FIG. 1A is a schematic top view of a prior art printhead including a nozzle array having resistive heaters.

Referring to FIG. 1A, a top view of a prior art printhead 10 of the continuous type like those described in, for example, U.S. Pat. Nos. 6,554,410 and 6,450,619, is shown. Printhead 10 uses temperature raising pulses to thermally stimulate drop creation. Printhead 10 includes nozzles 11, typically arranged in an array. The array can be linear or two-dimensional and its density can be at least 600 nozzles per inch. A source of fluid 9 provides fluid under pressure sufficient to eject a column of the fluid through the nozzles 11. The fluid has a temperature. Surrounding each nozzle on the printhead is a resistive heater 12, preferably activated by CMOS circuitry 8 to break up the ink stream as required for printing. The resistive heater 12 may take the shape of one or more portions of a ring surrounding the nozzle 11. A heat pulse or temperature raising pulse applied to the fluid jet by the activated heater causes that portion of the fluid jet to increase its temperature above the value it would have in the absence of activation and causes breakup of the fluid jet.

Figure 1B:
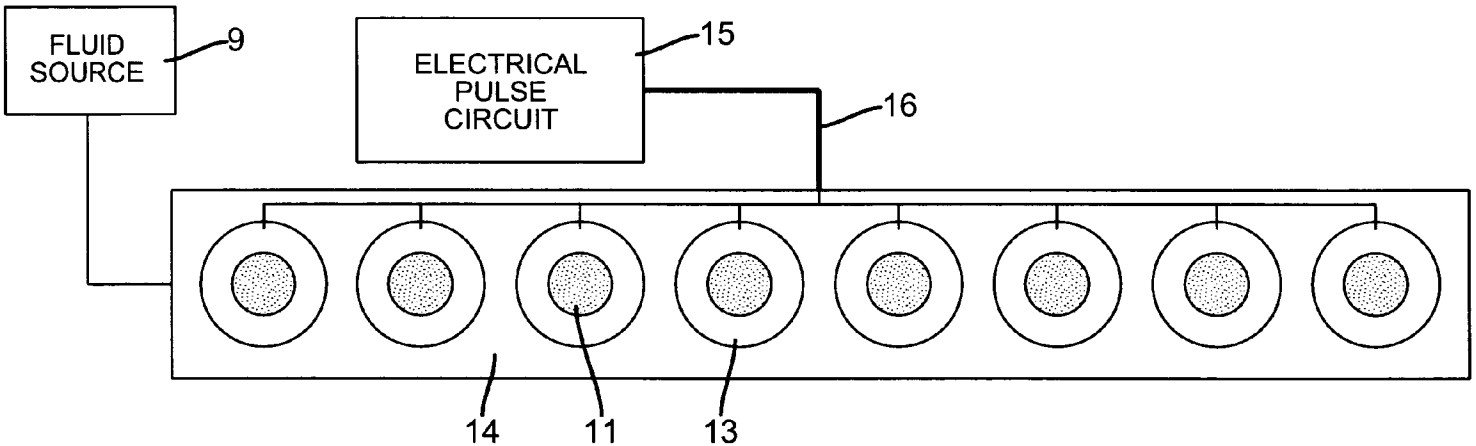
FIG. 1B PRIOR ART
FIG. 1B is a schematic top view of a prior art printhead including a nozzle array with thermal modulators associated with each nozzle.

Referring to FIG. 1B, there is shown a top view of a prior art thermal modulator printhead 14 of another continuous type printer of the thermal stimulation type in which either temperature raising or temperature lowering pulses can be applied to fluid jets using a thermal modulator like the one described in commonly assigned, co-pending U.S. patent application Ser. No. 11/504,960. A thermal modulator 13 is associated with each nozzle 11. The thermal modulator 13 is operable to either transiently lower or transiently raise the temperature of the fluid uniformly around the fluid jet as it is ejected through the nozzle 11. Thermal modulator 13 may be activated with an electric potential from electrical pulse circuit 15. The pulse circuit 15 is connected to thermal modulators 13 via electrical pulse connectors 16. A temperature raising pulse or a temperature lowering pulse can be applied symmetrically around each fluid jet in FIG. 1B causing a length along the jet to increase or decrease its temperature above or below the value it would have in the absence of the pulses. Temperature lowering pulse applied to the fluid jet after application of one or more temperature raising pulses reduces the coalescence length of large drops formed by the temperature raising pulses. Lowering the temperature of the fluid jet below the temperature it would otherwise have can also be referred to as removing heat from the fluid jet or cooling the fluid jet, and in this sense, the terms as used interchangeably. The disclosure of U.S. patent application Ser. No. 11/504,960 is incorporated by reference herein.

In commonly assigned, co-pending U.S. patent application Ser. No. 11/504,960, temperature lowering pulses are applied to fluid jets to reduce the "coalescence" time taken for large drops of fluid, which break momentarily into smaller drops, to reform. Temperature lowering pulses may be generated in many ways, for example, by using thermoelectric generators, endothermic chemical reactions, mechanical thermal cantilevers, gas compression pumps, etc. as described in U.S. patent application Ser. No. 11/504,960.

Temperature lowering pulses are separated in time from the temperature raising pulses to reduce coalescence time. Temperature lowering pulses and temperature raising pulses are applied symmetrically around a fluid jet to raise or lower its temperature from the temperature it would otherwise have. For example, one embodiment discloses a ring shaped conductor which can be either heated or cooled by a Peltier device depending on the polarity of the voltage pulses applied to the Peltier device. However, the device described in U.S. patent application Ser. No. 11/504,960 does not provide for deflection of the jets nor does it protect the jetted fluids from temperature excursions which may boil or decompose the fluids, since the temperature lowering pulses are applied at different times from the temperature raising pulses.

Figure 1C:
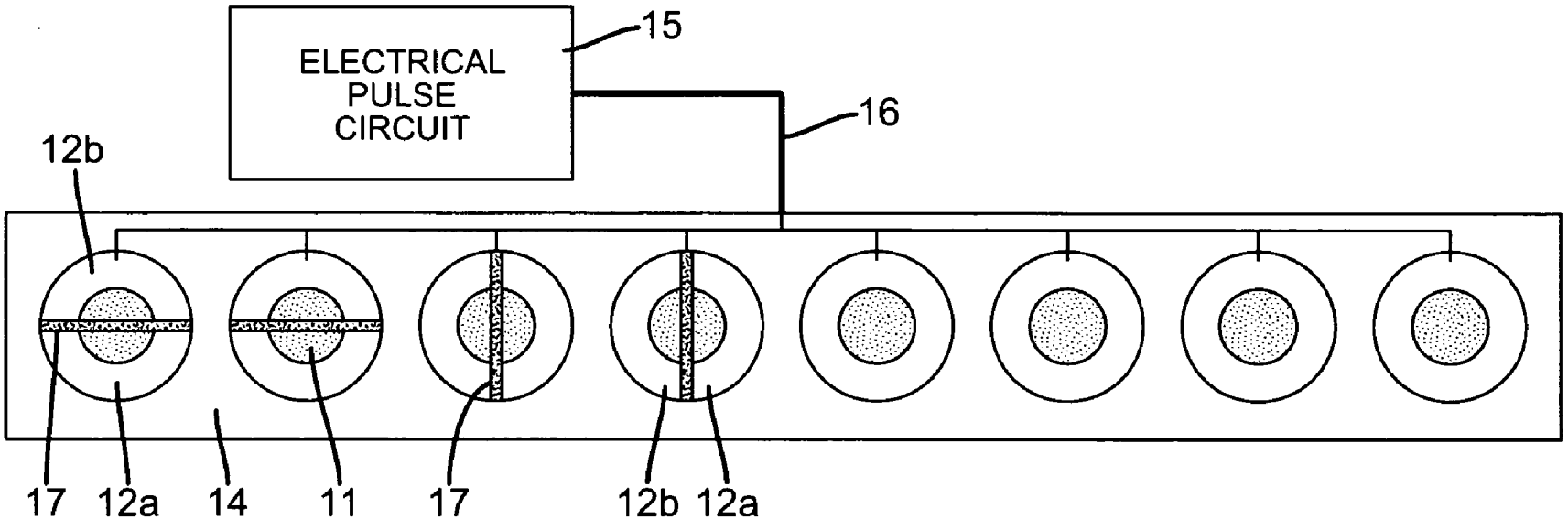
FIG. 1C PRIOR ART
FIG. 1C is a schematic top view of a prior art printhead including a nozzle array having asymmetric resistive heaters.

Referring to FIG. 1C there is shown a top view of another prior art printhead 10 of a continuous type printer of the thermal stimulation type having asymmetric resistive heaters, here shown as split ring resistive heaters 12*a* and 12*b* like those described in U.S. Pat. No. 6,079,821. The opposing sides of each split heater are shown schematically in FIG. 1C as separated by a bold diameter line 17. The split heater may be oriented in any direction. As shown in FIG. 1C, not all heaters need be split. Each side of each split-ring resistive heater is controlled independently by an electrical pulse circuit 15 and 16 which activates one or both sides of the split ring resistive heater by application of an electric potential. Thereby, a temperature raising pulse is applied to the side of the fluid jet proximate the activated heater causing that portion of the fluid jet to increase its temperature above the value it would have in the absence of activation. The prior art printhead 10 in FIG. 1C is not capable of delivering temperature lowering pulses to the fluid jet.

Figure 2A:
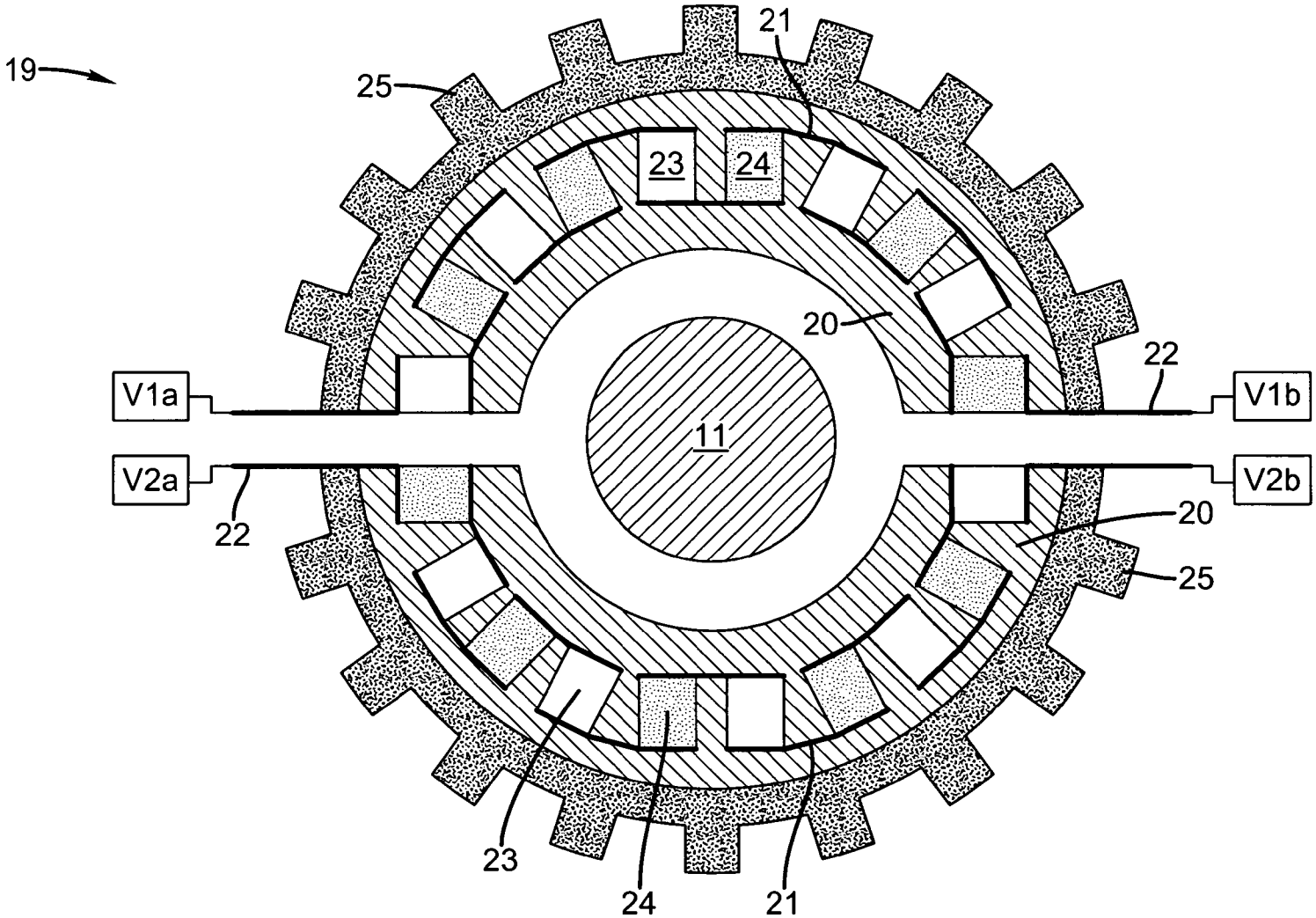
FIG. 2A is a top view of an example embodiment of an asymmetric thermal modulator in accordance with the present invention, the asymmetric thermal modulator being configured as a thermoelectric device.

Referring to FIG. 2A, an example embodiment in accordance with the present invention of an asymmetric thermal modulator 19 is shown configured as a thermoelectric device. The asymmetric thermal modulator is related to the thermal modulator of U.S. patent application Ser. No. 11/504,960. However, instead of comprising a ring-like structure surrounding a nozzle and operated symmetrically, an asymmetric thermal modulator is essentially a plurality of thermal modulator segments surrounding a nozzle each segment of which is independently operable, as described below. In FIG. 2A, thermal conductor 20 is directly in contact with the fluid stream. It is formed of a highly heat conductive material, such as polysilicon or a metal. In contact with the conductor 20, are n- and p-doped pellets 23 and 24 respectively, which are inherently responsible for heating and cooling, depending on the direction of current flow. The material doped to form the pellets may be, but is not restricted to, bismuth and telluride. N-doped pellets 23 and p-doped pellets 24 are joined together by the copper trace 21, which provides the path for electricity, and allows the pellets to be connected in series. Therefore, electrons in the n-doped pellets and holes in the p-doped pellets may transport heat in the same direction (either away from or towards the fluid stream running through nozzle 11). In the cooling operation, heat sink 25 provides the object into which the heat drawn out of the fluid stream may be dissipated. The pellets, connected via copper trace 21, are connected to a power supply through the electrodes 22 on either side of the thermal modulator. Finally, each electrode 22 is connected a DC power supply (represented using V1*a*, V1*b*, V2*a*, V2*b*) through a polarity-determining switch, whose setting determines whether the positive terminal of the power supply will be in contact with the n-doped pellet 23 or p-doped pellet 24. As a result, the inner portion of conductor 20 will be cooled or heated, respectively, as is well known in the art of Peltier cooling devices. If heat flows into the fluid stream from one side of the heat sink in FIG. 2A, for example the bottom side, and no heat flows into or out of the fluid stream from the other side of the heat sink in FIG. 2A, then the asymmetric thermal modulator so operated will have the same effect on the fluid jet as the heater disclosed in U.S. Pat. No. 6,079,821 when only one side is activated. The asymmetric thermal modulator described in FIG. 2A is distinguished from the thermal modulator of U.S. patent application Ser. No. 11/504,960 in that either side of the asymmetric thermal modulator 19 may be controlled electrically to an provide either temperature raising or temperature lowering "pulses" to the jet. Since a thermoelectric device is a heat pump, excess heat or cold is conducted away by heat sink 25 and is not felt by the jet stream.

Figure 2B:
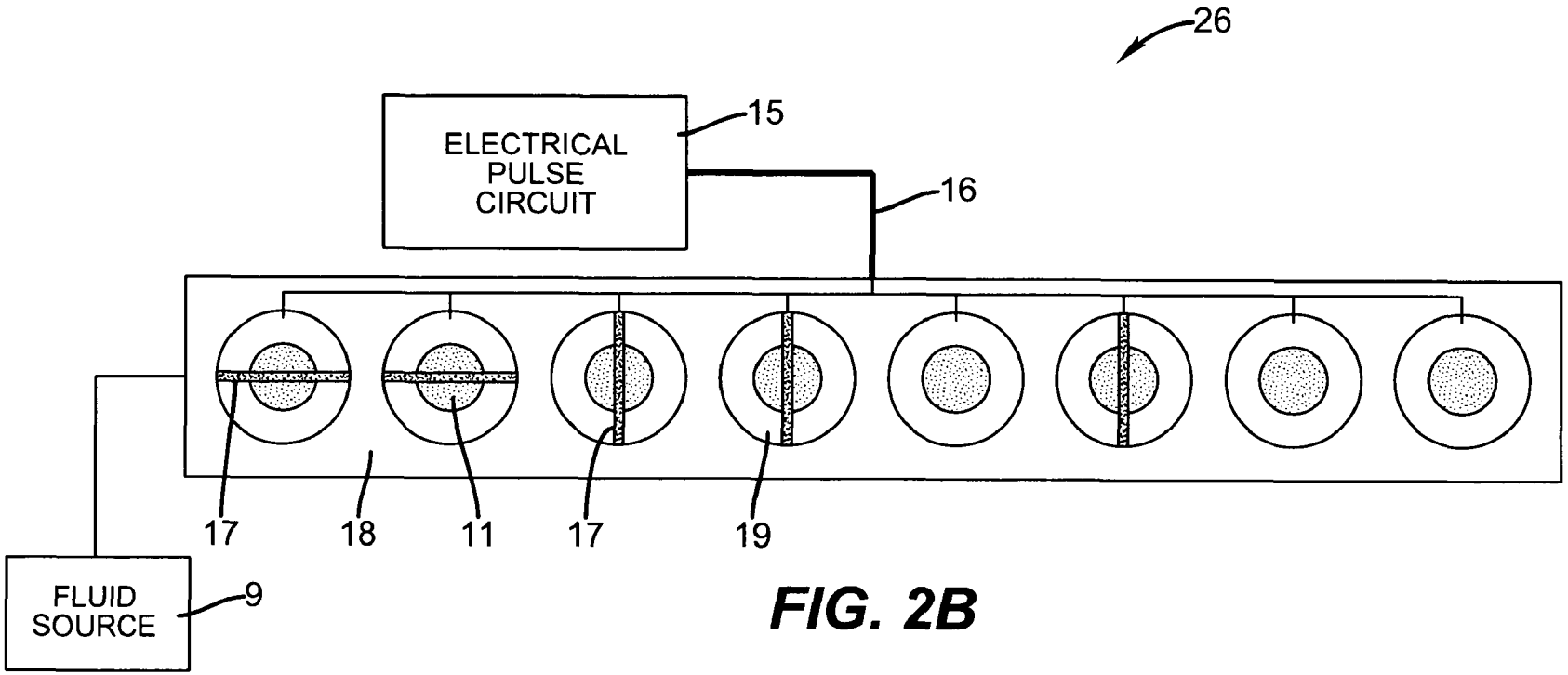
FIG. 2B is a schematic top view of a printhead including the asymmetric thermal modulators of FIG. 2A.

FIG. 2B shows an asymmetric thermal modulator printhead 26 having multiple asymmetric thermal modulators oriented at various angles. Bold lines 17 delineate the boundary between the portions of an asymmetric thermal modulator having, in this example, two portions.

Figure 2C:
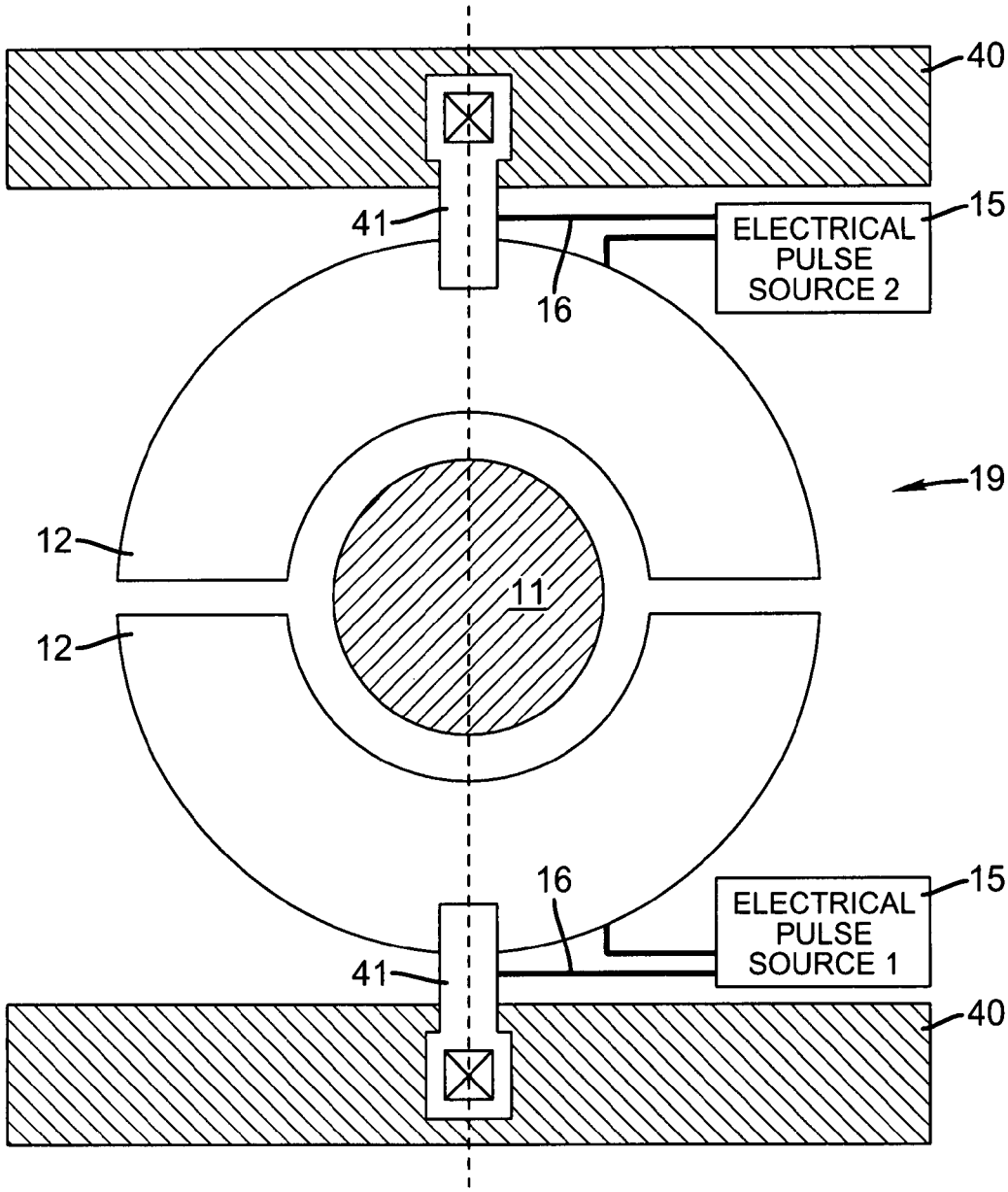
FIG. 2C is a schematic top view of another example embodiment of an asymmetric thermal modulator in accordance with the present invention, the asymmetric thermal modulator being configured as a micro-mechanical cantilever device.

FIG. 2C shows an asymmetric thermal modulator 19 of the micro-electromechanical cantilever configuration. Modulator 19 includes an asymmetric resistive heater 12 that is made out of a thermally conductive material to surround the nozzle bore 11. Therefore, heat pulses are controlled by electrical stimulation of the heater 12. However, cold pulses are created by keeping heater 12 off, and stimulating the deflection of the cantilever 41 tip until it touches the heater 12. The cantilever 41 is itself composed of a thermally conductive material such as, but not limited to, polysilicon or a metal. The cantilever 41 sits on a source 40 that supplies the low temperature for the cooling to take place. This temperature can be significantly below the ambient temperature of the jetting fluid. The low temperature source 40 may maintain its state through various means, such as but not limited to a thermoelectric cooling device. Hence, it is the deflection of cantilever 41 that achieves the cold pulse application to the jetting fluid by selectively connecting heater 12 to the constant source of low temperature 40. The deflection of cantilever 41 itself may be controlled through electrostatics. Independent electrical pulse sources 15 and 16 control operation of split heater 12 and cantilevers 4.

U.S. patent application Ser. No. 11/504,960 also describes alternative embodiments of thermal modulators having configurations other than the Peltier configuration shown in FIG. 1B. For example, a thermal modulator using a micro-electromechanical cantilever configuration is described. Based on the discussion above which describes the relation between a thermal modulator of the Peltier configuration, shown in FIG. 1B, and the corresponding asymmetric thermal modulator of the Peltier configuration, shown in FIGS. 2A and 2B, it can be seen that each alternative embodiment in U.S. patent application Ser. No. 11/504,960 of a thermal modulator can be used in the construction of a corresponding asymmetric thermal modulator.

For example, an asymmetric thermal modulator using a micro-electromechanical cantilever configuration may be constructed by taking two operable portions, for example, halves, of the thermal modulator of the micro-electromechanical cantilever configuration described in U.S. patent application Ser. No. 11/504,960, positioning these two portions around a common nozzle, and operating the two portions independently, for example by connecting each portion to an electrical pulse controller. Each of the two independently operable portions can provide either temperature raising pulses or temperature lowering pulses to fluid jetting from the common nozzle, thereby providing an alternative modulator using a micro-electromechanical cantilever configuration. Accordingly, as can be appreciated by one skilled in the art, any of the thermal modulators described in U.S. patent application Ser. No. 11/504,960 can be made into corresponding asymmetric thermal modulators of that type even though the thermal modulators disclosed in U.S. patent application Ser. No. 11/504,960 are intended to extend continuously around their corresponding nozzles. For the purposes of the present invention, all such types are operationally equivalent.

FIGS. 2D(i) and (ii) schematically show an exemplary voltage waveform capable of operating the asymmetric thermal modulator shown in FIGS. 2A-2C to produce hot and cold pulses on the two portions of an asymmetric thermal modulator 19. In FIG. 2D(i), a temperature raising pulse followed by a temperature lowering pulse is produced by the waveform shown and is delivered, for example, to the right portion of an asymmetric thermal modulator in FIG. 2B. A temperature lowering pulse followed by a temperature raising pulse is produced by the waveform depicted in FIG. 2D(ii) and is delivered simultaneously, for example, to the left portion of an asymmetric thermal modulator in FIG. 2B. During operation, the waveforms are provided from electrical pulse generators 15 and 16 activate asymmetric thermal modulator 19. The voltage referenced on the waveform graph, $V_{1a\text{-}1b}$, ($V_{2a\text{-}2b}$) describes the voltage applied to the top (bottom) portion of electrode 22 versus time (measured in microseconds) as shown in FIG. 2A.

Regardless of the specific configuration of asymmetric thermal modulator 19, asymmetric thermal modulator in accordance with the present invention typically includes at least two independently operated thermal modulator portions with each portion being positioned proximate, for example, surrounding a common nozzle. Each portion (for example, a right side or a left side as shown in FIG. 2B) of an asymmetric thermal modulator in accordance with the present invention is capable of providing either temperature raising pulses or temperature lowering pulses to that portion of fluid jetting from the common nozzle proximate the corresponding portion (or side). The operation of an asymmetric thermal modulator having at least two independent portions to achieve large jet deflections in accordance with the present invention typically includes independent and simultaneous operation of the at least two asymmetric thermal modulator portions so that temperature raising pulses and temperature lowering pulses are simultaneously provided to opposite sides of fluid jetting from the common nozzle.

Figure 2F:
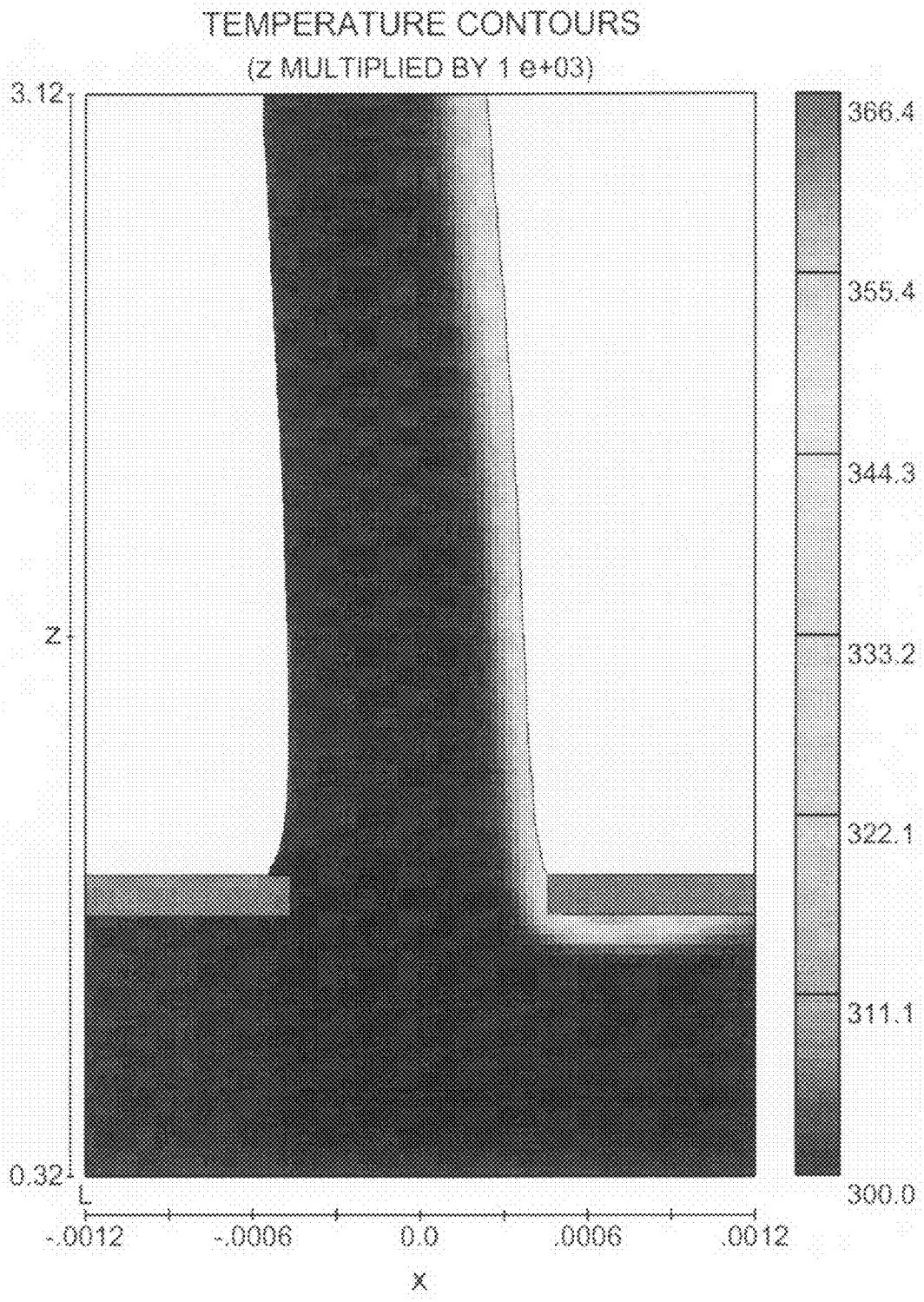
FIG. 2F shows model results for deflection of the trajectory of a fluid jet obtained by applying a temperature raising pulse to one side of the asymmetric thermal modulator shown in FIG. 2C (in this instance, the right side of the asymmetric thermal modulator shown in FIG. 2C) in which the fluid jet deflects away from the side to which the temperature raising pulse is applied.

Referring to FIGS. 2E(i) and (ii) and FIG. 2F, FIGS. 2E(i) and (ii) show a schematic diagram of voltage waveforms capable of operating the asymmetric thermal modulator of FIGS. 2A-2C to produce only temperature raising pulses on the right portion of the asymmetric thermal modulator as shown in FIG. 2B. FIG. 2F shows model results of the deflection of the trajectory of a fluid jet away from the vertical direction in response to a temperature raising pulse applied to the right side of an asymmetric thermal modulator. As such, this method of operation of an asymmetric thermal modulator is similar to the methods of operation described above with reference to FIGS. 1A and 1C. However, the method of operation of the present invention differs from the methods of operation described above with reference to FIGS. 1A and 1C in that asymmetric thermal modulator 19 can provide both temperature raising and temperature lowering pulses although only temperature raising pulses are provided in FIGS. 2E(i) and (ii).

The schematic diagram of FIGS. 2E(i) and (ii) shows the waveform provided to the asymmetric thermal modulator 19 of FIG. 2F to provide temperature raising pulses to the right side of the fluid jet. Neither temperature lowering pulses nor temperature raising pulses are provided to the other side of the asymmetric thermal modulator 19. Therefore, the deflection from application of the waveforms shown in FIGS. 2E(i) and (ii) to asymmetric thermal modulator 19 would be expected to be similar to the deflection described in U.S. Pat. No. 6,079,821, in which only one side of a split heater provides heat to one side of a fluid jet.

Figure 2G:
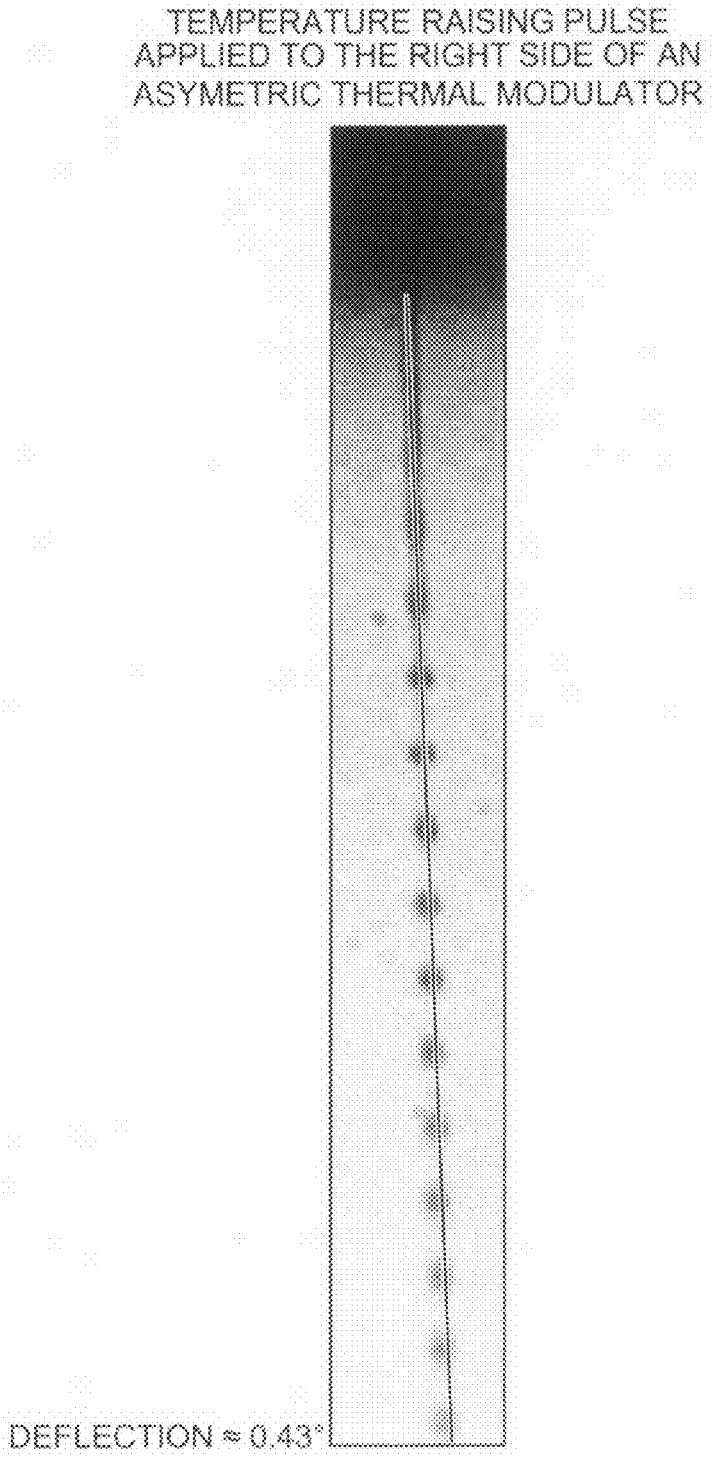
FIG. 2G shows experimental results for deflection of the trajectory of a fluid jet by applying a temperature raising pulse to one side of the asymmetric thermal modulator shown in FIG. 2C (in this instance, the right side of the asymmetric thermal modulator shown in FIG. 2C) in which the fluid jet deflects away from the side to which the temperature raising pulse is applied.

This expectation is confirmed by the experimental results shown in FIG. 2G, which shows a photograph of the deflection of a jet having an asymmetric thermal modulator activated by the waveform of FIG. 2E. This experimental result is essentially identical to that for a thermal modulator operated with only one side activated, as disclosed in U.S. Pat. Nos. 6,079,821 and 6,450,619. It is to be appreciated that as described in U.S. Pat. No. 6,079,821, the deflection of the jet before it breaks up into drops can be observed close to the nozzle, where as the deflected jet after breakup into drops occurs farther from nozzle. In FIGS. 2G and 2F, the direction of the trajectory of the drops and the trajectory of the jet, respectively, are identical and thus in equilibrium. The deflection of the jet is well defined regardless of whether the jet is shown as a continuous column of fluid or after breakup into drops.

In accordance with the present invention, the inventors have discovered that when the two sides of an asymmetric thermal modulator 19 including two sides are independently operated such that one side provides temperature raising pulses and the other side simultaneously provides temperature lowering pulses to fluid jetting from the common nozzle, the fluid jet trajectory is deflected by an amount that is larger than the deflection observed due to application of temperature raising pulses alone to either side of the asymmetric thermal modulator. That is, the amount deflection is larger than the amount of deflection achieved for the situation described with reference to FIG. 2D or in U.S. Pat. No. 6,079,821. The jet is deflected away form the side of the jet proximate the side of the asymmetric thermal modulator 19 providing the temperature raising pulse and toward the side of the jet proximate the side of the asymmetric thermal modulator providing the temperature lowering pulse.

The inventors have also discovered that the fluid jetting from an asymmetric thermal modulator including two sides, one side of which is operated to provide a temperature lowering pulse and the other side of which is operated to provide neither a temperature raising nor a temperature lowering pulse, is deflected toward the side of the jet proximate the side of the asymmetric thermal modulator providing the temperature lowering pulse.

Unexpectedly, the inventors have also discovered that when the two sides of an asymmetric thermal modulator having two sides are independently operated such that one side provides temperature raising pulses and the other side simultaneously provides temperature lowering pulses to fluid jetting from the common nozzle, the simultaneous temperature raising and temperature lowering pulses not only provide enhanced deflection of the fluid jet but also serve to reliably break up the fluid jet into well defined droplets. Typically, the simultaneous temperature raising and temperature lowering pulses are provided by voltage waveforms applied independently from electrical pulse circuits 15 and 16 to the different sides of the asymmetric thermal modulator 19.

Moreover, the inventors have discovered that when the two sides of an asymmetric thermal modulator including two sides are independently operated such that a first side provides temperature raising pulses and a second side simultaneously provides temperature lowering pulses to fluid jetting from the common nozzle, the fluid jet trajectory is deflected by an amount that is nearly equal to the sum of the deflections obtained from two cases, one case in which the temperature raising pulse is applied is applied to the first side and no pulses are applied to the second side and the other case in which a temperature lowering pulse is applied is applied to the second side and no pulses are applied to the first side. In other words, the deflection of the jet is the sum of the deflections obtained from independent application of temperature raising and temperature lowering pulses to opposite sides of an asymmetric thermal modulator. It is observed that the fluid jetting from an asymmetric thermal modulator is deflected away from the side of the jet proximate the side of the asymmetric thermal modulator providing temperature raising pulses and toward the side of the jet proximate the side of the asymmetric thermal modulator providing temperature pulses. These discoveries are illustrated by the waveform graphs and experimental results described below.

FIGS. 3A(i) and (ii) are control diagrams showing graphs of the voltage waveforms applied to different sides of an asymmetric thermal modulator 19 to provide deflection in a first direction. Both temperature raising and temperature lowering pulses are applied simultaneously. As can be appreciated by one skilled in the art, waveforms such as those shown in FIG. 3A(ii) can be combined with a dc offset to provide a waveform which is the sum of a dc offset and a temperature lowering pulse.

FIGS. 3B(i) and (ii) are control diagrams showing graphs of the waveforms applied to different sides of an asymmetric thermal modulator 19 to provide deflection in a second direction. Both temperature raising and temperature raising pulses are applied simultaneously. As can be appreciated by one skilled in electrical engineering, waveforms such as those shown in FIG. 3B(i) can be combined with a dc offset to provide a waveform which is the sum of a dc offset and a temperature lowering pulse.

FIGS. 3C(i) and (ii) are control diagrams showing graphs of the voltage waveforms applied to one side of an asymmetric thermal modulator 19 to provide deflection in a first direction. Only a temperature lowering pulse is applied. Waveforms such as those shown in FIG. 3C(ii) can be combined with a dc offset, as described above.

Figure 4A:
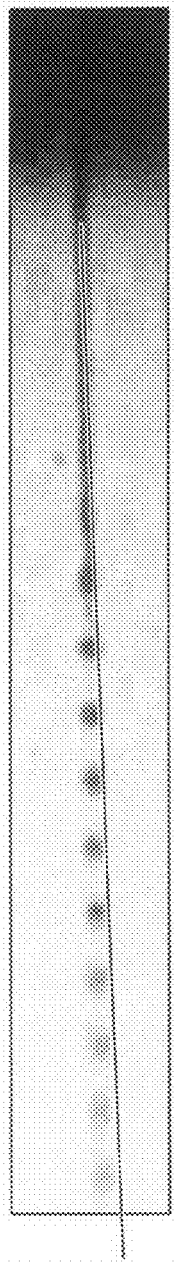
FIG. 4A shows experimental results for deflection of the trajectory of a fluid jet by the waveforms of FIG. 3A(i) and (ii) in which the fluid jet deflects away from the side to which the temperature raising pulses are applied and toward the side to which temperature lowering pulses are applied.

FIG. 4A shows experimental data corresponding to the waveforms of FIGS. 3A(i) and (ii) and 3B(i) and (ii) for the deflection of a fluid jetting from an asymmetric thermal modulator 19. The jet is deflected away from the side of the jet proximate the side of the asymmetric thermal modulator providing a temperature raising pulse and toward the side of the asymmetric thermal modulator providing a temperature lowering pulse in both cases. As these two cases are equivalent when the jet is rotated 180 degrees, the absolute amount of deflection is the same for the waveforms of FIGS. 3A(i) and (ii) and 3B(i) and (ii). As is shown in FIG. 4A, it is clear that when the two sides of an asymmetric thermal modulator having two sides are independently operated such that one side provides temperature raising pulses and the other side simultaneously provides temperature lowering pulses to fluid jetting from the common nozzle, the fluid jet trajectory is deflected by an amount that is nearly the sum of the deflections obtained from either side so operated alone.

Figure 4B:
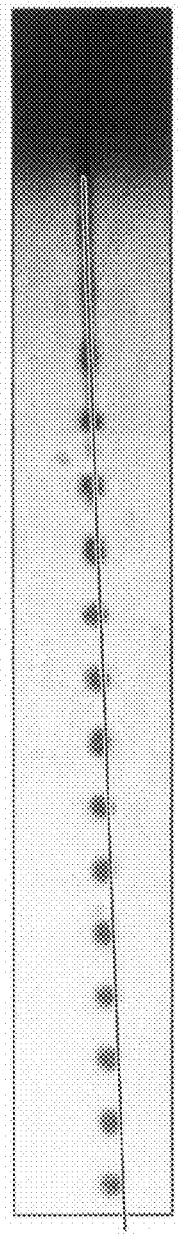
FIG. 4B shows experimental results for deflection of the trajectory of a fluid jet by the waveform of FIGS. 3C(i) and (ii) in which the fluid jet deflects toward the side to which temperature lowering pulses are applied.

FIG. 4B shows experimental data for the cases where two sides of an asymmetric thermal modulator having two sides are independently operated such that the first side provides temperature lowering pulses while the other side provides no temperature pulses, corresponding to the waveform graph of FIGS. 3C(i) and (ii). Temperature lowering pulses alone are found experimentally to deflect fluid jets in a direction toward the side of the asymmetric thermal modulator to which the temperature lowering pulses alone are applied.

FIG. 4C shows a table summarizing the experimental results for water based inks for two cases of voltage waveform amplitudes, 4.5 and 5.0 volts. The columns labeled "Temperature raising pulse" and "Temperature lowering pulse" correspond to the waveform graphs of FIGS. 2E(i) and (ii) and 3C(i) and (ii), respectively, while the column labeled "Simultaneous temperature raising and lowering pulses" correspond to the waveform graphs of FIGS. 3A(i) and (ii) and 3B(i) and (ii). The data presented in the table of FIG. 4C shows that when the two sides of an asymmetric thermal modulator having two sides are independently operated such that one side provides temperature raising pulses and the other side simultaneously provides temperature lowering pulses to fluid jetting from the common nozzle, the fluid jet trajectory is deflected by an amount approximately equal to the sum of the deflections obtained from independent application of temperature raising and temperature lowering pulses to opposite sides of an asymmetric thermal modulator. In all cases shown, the fluid jetting from an asymmetric thermal modulator is deflected away from the side of the jet proximate the side of the asymmetric thermal modulator providing temperature raising pulses and toward the side of the jet proximate the side of the asymmetric thermal modulator providing temperature pulses.

Referring back to FIG. 4A, it can be seen that the fluid jet is not only deflected but is also broken into regular droplets which is the like the method of operation described in U.S. Pat. No. 6,079,821. However, this result is entirely unexpected because the effects on drop break up are theoretically expected to be opposite for temperature raising and temperature lowering pulses. Thus, one might expect simultaneous application of temperature lowering pulses and temperature raising pulses to result in no breakup at all. However, it has been clearly established experimentally that this is not the case.

It can be seen in FIG. 4B, corresponding to the case in which only temperature lowering pulses are applied, that the fluid jet is also broken into regular droplets, as in the case described in U.S. Pat. No. 6,079,821. However, this result is entirely unexpected because the effect of temperature pulses on drop break up are theoretically expected to be opposite for temperature raising and temperature lowering pulses.

Figure 5A:
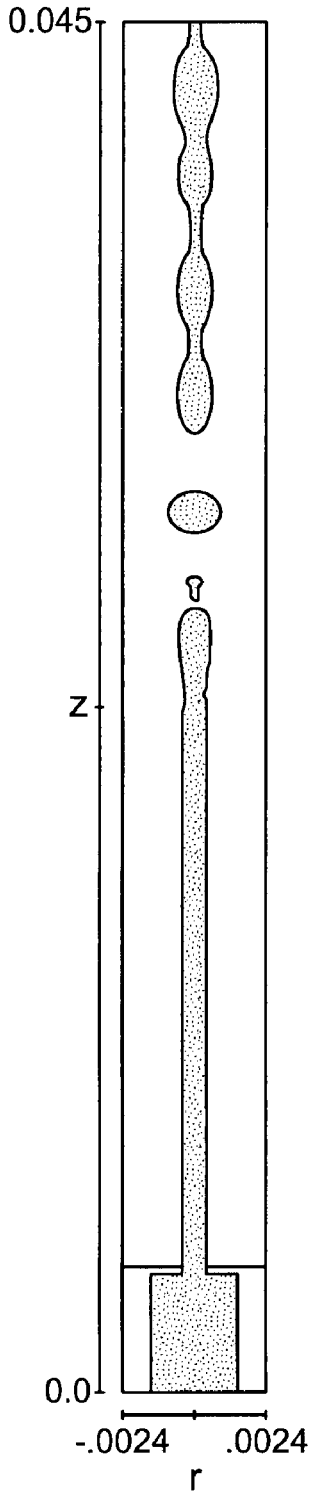
FIG. 5A shows an expanded view of the modeled break-off of a stream of fluid drops in accordance with the waveform graphs shown in FIG. 3A(i)
Figure 5B:
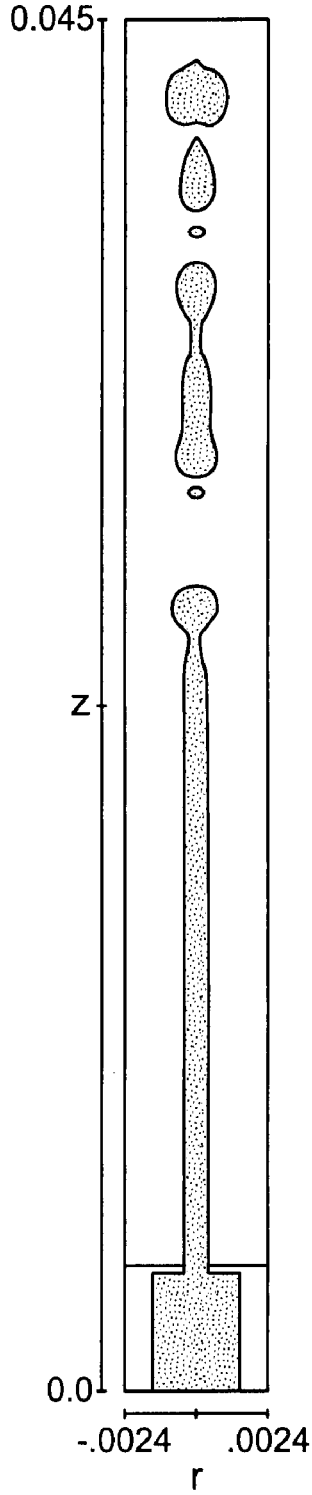
FIG. 5B shows an expanded view of the modeled break-off of a stream of fluid drops in accordance with the waveform graphs shown in FIG. 3A(ii)

Model results are shown in FIGS. 5A and 5B for the cases in which temperature raising and temperature lowering pulses are applied symmetrically to a fluid jet. As can be appreciated by one skilled in the art, this break-off of the jets stimulated symmetrically with a temperature raising (temperature lowering) pulse is similar to the case in which the pulses are applied to only one side of an asymmetric thermal modulator, at least in the relation of the temperature profile of the jet to the jet diameter. As can be seen in FIG. 5A, the case in which a temperature raising pulse is applied, the jet pinches off very nearly in the region where the jet surface temperature is above that which it would have been in the absence of the pulse. Similarly, as can be seen in FIG. 5B, the case in which a temperature lowering pulse is applied, the jet pinches off very nearly in the region where the jet surface temperature is below that which it would have been in the absence of the pulse. Therefore, the effects of a temperature lowering pulse vs. a temperature raising pulse are opposite in their tendencies to change the diameter of the fluid jet. It is well known that a decrease (increase) in the diameter of a fluid jet causes the jet to collapse (expand). Thus, it might be expected that the simultaneous application of temperature lowering pulses and temperature raising pulses applied by an asymmetric thermal modulator results in decreased reliability of drop break-off because the effects of temperature lowering pulses and temperature raising pulses have opposite effects on the diameter of the jet.

Figure 6A:
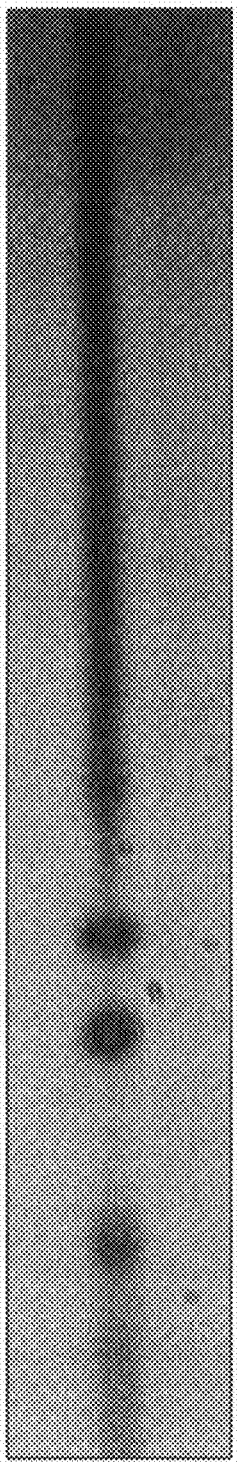
FIG. 6A shows an expanded view of the experimentally observed break-off of a stream of fluid drops due to a temperature raising pulse in accordance with the waveform graphs shown in FIG. 2E(i)
Figure 6B:
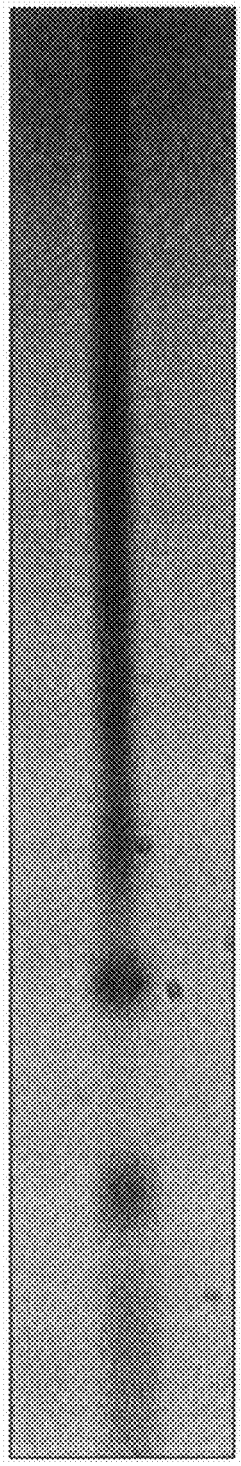
FIG. 6B shows an expanded view of the experimentally observed break-off of a stream of fluid drops due to simultaneous application of a temperature raising pulse and a temperature lowering pulse on opposite sides of an asymmetric thermal modulator in accordance with the waveform graphs shown in FIGS. 3A(i) and (ii).

Surprisingly, this is not what happens as is shown in FIGS. 6A and 6B. In FIG. 6A, drop break off is shown when only a temperature raising pulse is applied. In FIG. 6B, drop break off is shown when a temperature raising pulse is simultaneously applied with a temperature lowering pulse. Although the characteristics of the jet break-off differ, the jets in both cases produce reliable drop break-of, that is they both reliable provide a sequence of drops without satellites at the frequency of application of the temperature raising pulses (or in FIG. 6B, simultaneous temperature raising and temperature lowering pulses). The reason for this unexpected reliability of drop break-off is not understood.

While these observations are unexpected, their implications are highly advantageous. Not only are temperature lowering pulses, applied using an asymmetric thermal modulator, useful in increasing the amplitude of deflection, they in no way interfere with or mitigate reliable drop breakup. As is well know in the art of inkjet printing, reliable drop breakup is critical to the quality of printed images. Thus while it might be expected that the simultaneous application of temperature lowering pulses and temperature raising pulses might result in decreased reliability of drop break-off, this feature, useful in the practice of the devices disclosed in U.S. Pat. No. 6,079,821, is apparently and advantageously not compromised. Additionally, reliability of drop break-off, as well as deflection, can be achieved with only of temperature lowering pulses.

Although the term printhead is used herein, it is recognized that printheads are being used today to eject other types of fluids and not just ink. For example, as can be appreciated by one skilled in the art of data flow and device control, there are many ways of providing for the application of temperature raising and temperature lowering pulses other than electrical circuits, for example pulses could be triggered by light signals carrier in optical fibers or by radio frequency waves. For example, the ejection of various fluids including medicines, pigments, dyes, conductive and semi-conductive organics, metal particles, and other materials is possible today using a printhead. As such, the term printhead is not intended to be limited to just devices that eject ink.

The invention has been described in detail with particular reference to certain example embodiments thereof, but it will be understood that variations and modifications can be effected within the scope of the invention.

PARTS LIST

1 Contact electrode
2 Contact electrode
4 Cantilevers
8 Cmos circuitry
9 Fluid source
10 Printhead
11 Nozzle
12*a* Resistive heater
12*b* Asymmetric resistive heater
13 Thermal modulator
14 Thermal modulator printhead
15 Electrical pulse source
16 Electrical pulse connector
18 Asymmetric thermal modulator printhead
19 Asymmetric thermal modulator
20 Thermal conductor
21 Copper trace (electric path)
22*a* Contact electrode 1
22*b* Contact electrode 2
23 N-doped pellet
24 P-doped pellet
25 Heat sink
40 low temperature source
41 Conducting micro electromechanical cantilever beam
42 Electrode
55 Fluid source

The invention claimed is:

1. A printer comprising:

a printhead including a nozzle;

a source of fluid, the fluid being under pressure sufficient to eject a column of the fluid through the nozzle, the fluid having a temperature; and an asymmetric thermal modulator associated with the nozzle, the asymmetric thermal modulator including a structure that transiently lowers the temperature of a first portion of the fluid as the fluid is ejected through the nozzle and a structure that transiently raises the temperature of a second portion of the fluid as the fluid is ejected through the nozzle, wherein the structure of the asymmetric thermal modulator that transiently lowers the temperature of a first portion of the fluid is simultaneously actuatable with the structure of the asymmetric thermal modulator that transiently raises the temperature of a second portion of the fluid.

2. The printer of claim 1, further comprising:

an electrical pulse source in electrical communication with the asymmetric thermal modulator to provide a waveform to the structure of the asymmetric thermal modulator that transiently lowers the temperature of a first portion of the fluid and provide a waveform to the structure of the asymmetric thermal modulator that transiently raises the temperature of a second portion of the fluid.

3. The printer of claim 2, wherein the electrical pulse source provides the waveforms simultaneously.

4. The printer of claim 2, wherein the electrical pulse source includes a dc voltage bias.

5. The printer of claim 1, wherein the asymmetric thermal modulator is positioned to surround the nozzle.

6. The printer of claim 1, wherein at least one of the structures of the asymmetric thermal modulator includes a Peltier device.

7. The printer of claim 1, wherein at least one of the structures of the asymmetric thermal modulator includes a mechanical cantilever.

8. The printer of claim 1, wherein the printhead includes a plurality of nozzles arranged in an array having a density of at least 600 nozzles per inch.

9. A method of forming fluid drops comprising:

providing a printhead including a nozzle;

providing a fluid under pressure sufficient to eject a column of the fluid through the nozzle, the fluid having a temperature; and transiently lowering the temperature of a first portion of the fluid as the fluid is ejected through the nozzle and transiently raising the temperature of a second portion of the fluid as the fluid is ejected through the nozzle using an asymmetric thermal modulator, wherein transiently lowering the temperature of a first portion of the fluid and transiently raising the temperature of a second portion of the fluid occurs simultaneously.

10. The method of claim 9, wherein transiently lowering the temperature of a first portion of the fluid and transiently raising the temperature of a second portion of the fluid includes providing an electrical pulse source in electrical communication with the asymmetric thermal modulator, and operating the electrical pulse source to provide a waveform to the asymmetric thermal modulator that transiently lowers the temperature of the first portion of the fluid and transiently raises the temperature of the second portion of the fluid.

11. The method of claim 10, wherein providing the electrical pulse source in electrical communication with the asymmetric thermal modulator includes providing an electrical pulse source including a dc voltage bias.

12. The method of claim 9, wherein the asymmetric thermal modulator includes a thermoelectric device.

13. The method of claim 9, wherein the asymmetric thermal modulator includes a mechanical cantilever.

* * * * *